US011028804B2

(12) United States Patent
Storey

(10) Patent No.: US 11,028,804 B2
(45) Date of Patent: Jun. 8, 2021

(54) EXHAUST GAS RECIRCULATION ELEMENT CLEANER AND METHOD OF USE

(71) Applicant: Fleet Emission Solutions, Inc., Burgessville (CA)

(72) Inventor: Scott Storey, Burgessville (CA)

(73) Assignee: Fleet Emission Solutions Inc., Burgessville (CA)

( * ) Notice: Subject to any disclaimer, the term of this patent is extended or adjusted under 35 U.S.C. 154(b) by 15 days.

(21) Appl. No.: 16/279,808

(22) Filed: Feb. 19, 2019

(65) Prior Publication Data

US 2019/0257275 A1 Aug. 22, 2019

Related U.S. Application Data

(60) Provisional application No. 62/633,032, filed on Feb. 20, 2018.

(51) Int. Cl.

| | |
|---|---|
| ***F02M 26/35*** | (2016.01) |
| ***B08B 9/032*** | (2006.01) |
| ***B08B 9/00*** | (2006.01) |
| ***B08B 13/00*** | (2006.01) |

(52) U.S. Cl.

CPC ..... *F02M 26/35* (2016.02); *B08B 9/00* (2013.01); *B08B 9/0321* (2013.01); *B08B 13/00* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,826,602 | A | 10/1998 | Chen | |
| 6,652,667 | B2 | 11/2003 | Ahmadi | |
| 9,266,055 | B2 | 2/2016 | Konigsson | |
| 2006/0124114 | A1* | 6/2006 | Sayers | F28D 9/005 123/568.12 |
| 2008/0011327 | A1* | 1/2008 | Shriner | C11D 11/0041 134/22.19 |
| 2013/0037493 | A1* | 2/2013 | Konigsson | B01D 21/262 210/787 |

* cited by examiner

*Primary Examiner* — Erin F Bergner
(74) *Attorney, Agent, or Firm* — Cherskov Flaynik & Gurda, LLC

(57) ABSTRACT

The present invention provides an EGR cleaning station and method of use for efficiently cleaning EGR from soot and debris. The gas recirculation cleaning station is primarily comprised of: a cleaning tank; a water tank; a heating system; a pump; an inlet hose; an outlet hose; and, exterior housing. The EGR cleaning station isolates the EGR while mounted onto the internal combustion engine. The method of cleaning the EGR through the use EGR cleaning station in a stepwise manner, first cleaning the EGR by circulating the cleaning solution, then rinsing the EGR with circulating water. The cleaning of the EGR occurs without the need to remove the EGR from the internal combustion engine.

10 Claims, 10 Drawing Sheets

50

80

120

EXHAUST GAS RECIRCULATION ELEMENT CLEANER AND METHOD OF USE

PRIORITY CLAIM

The instant application claims priority as a non-provisional filing of U.S. Application 62/633,032, filed on Feb. 20, 2018, the contents of which are incorporated herein by reference.

FIELD OF THE INVENTION

This invention relates to a device and a method for removing engine deposits from the Exhaust Gas Recirculation element of a gasoline or diesel internal combustion engine. More specifically, this invention relates to a device, which when attached to the Exhaust Gas Recirculation element of the gasoline or diesel internal combustion engine, introduces a cleaning solution that removes soot and other deposits, and allows the gasoline internal combustion engine to run at optimal efficiency.

BACKGROUND

Fuel systems of internal combustion engines store, deliver, transfer and process fuel through enclosed passages, chambers and pumping/monitoring/metering devices. Over time, the elements described above of the internal combustion engine get clogged with fine particles of soot particulate, formed from incomplete fuel combustion, usually comprised of carbon and nitric oxide. Of specific interest, the Exhaust Gas Recirculation (EGR) element within the internal combustion engine is particularly prone to soot formation and subsequent clogging.

EGR is a nitrogen oxide emissions reduction element used in gasoline and diesel engines. EGR recirculates a portion of the engine's exhaust gas back into the engine cylinders. In doing so, the recirculated exhaust acts as an inert gas that absorbs combustion heat within the cylinders to reduce peak in-cylinder temperatures. The exhaust gas recirculating through the EGR is cooled with a heat exchange to allow greater mass of recirculated gas to enter into the cylinder. Additional benefits of the EGR includes but not limited to: reduced throttling losses; reduced heat rejection; and, reduced chemical dissociation.

EGR is an element that needs to be cleaned regularly. Service manuals state that the EGR should be cleaned every six (6) to eighteen (18) months. If left uncleaned excessive soot will build up in the EGR and will cause a range of engine issues/problems including but not limited to: decreased engine performance; decreased engine efficiency; the malfunction of a wide variety of engine sensors, EGR system complete, due to increased pressure buildup and clogging of the sensors; potting of the metal within the EGR; and eventual breakdown of the EGR. Generally, and as recommended by the auto manufacturers, the EGR is cleaned through a complete removal of the EGR element from the internal combustion engine and each individual piece of the EGR element is cleaned with a brush. This type of cleaning procedure is quite time consuming and very inefficient. Firstly, the EGR element is not on the periphery of the internal combustion engine. Secondly, as a channel for recirculating exhaust, it has numerous and heavily involved connection points that connect it to the internal combustion engine. To remove the EGR element would require a lot of work and almost removing the entire internal combustion engine from the engine bay. Furthermore, cleaning the EGR with a brush is not an effective means for cleaning the EGR element. There are numerous small apertures, bores and sensor elements within the EGR element that would be either difficult to reach with a brush or do not provide sufficient surface area to permit cleaning with a brush.

Various attempts have been made to alleviate the inconvenience associated with brush cleaning of the EGR element through physically removing the EGR element from the internal combustion engine. Prior publications such as U.S. Pat. No. 9,266,055 (Konigsson); U.S. Pat. No. 5,826,602 (Chen); and U.S. Pat. No. 6,652,667 (Ahmadi) provide such examples of EGR and internal combustion engine cleaning methods and devices.

All three patents described below have a number of inherent deficiencies. Firstly, the patents describe a method of cleaning the entire engine while in operation. These types of systems add a level of complexity to the internal combustion engine and require a means of incorporating the internal combustion engine cleaning method and device into the internal combustion engine build. This would require acceptance and compliance from most internal combustion engine manufacturers, as the engine cleaning device would have to be incorporated in the build. Secondly, the engine cleaning devices described in the patents below attempt to clean the complete internal combustion engine and not the EGR element alone. The problem with this type of cleaning, is that the cleaning solution will reach every section of the internal combustion engine, and as a result, the cleaning solution is required to have additional properties that ensures the internal combustion engine can operate in its presence. These additional properties reduce the cleaning solutions cleaning propensity. As a result, the EGR and the complete internal combustion engine will not be fully cleaned.

Konigsson discloses an exhaust cleaning equipment including a gas scrubber and a scrubber fluid cleaning equipment for cleaning polluted scrubber fluid. The scrubber fluid cleaning equipment includes a centrifugal separator for separating at least a pollutant phase and a cleaned scrubber fluid. The use of the centrifugal separator in Konigsson attempts to separate the pollutant from the cleaning scrubber fluid in order to decrease the pollution of the surrounding environment wherein the internal combustion engine is used. Konigsson's use of the cleaning equipment relates to ship diesel engines, and as such, spillage of polluted cleaning scrubber solution is of utmost importance. The Konigsson system requires the device to be built within the internal combustion engine.

Chen discloses an improved process and apparatus for flushing carbon deposits and contaminants from fuel and air intake systems of an internal combustion engines. More specifically, Chen process and apparatus for flushing carbon deposits and contaminates from surfaces of fuel injector nozzles, intake valves, and combustion chambers. Chen is primarily focused on an automatic operation of the apparatus for flushing carbon deposits while the internal combustion is in use through the use of various sensors within the internal combustion engine. Furthermore, Chen introduces two (2) cleaning solutions through the air intake and the fuel tank. As such, the cleaning solutions run through all key elements within the internal combustion engine. The cleaning solutions will come into direct contact with all key elements of the engine and are removed through continual use of the engine and through multiple refueling. It is uncertain what type of impact the cleaning solutions have on the essential elements of the internal combustion engine or its impact on efficiency throughout the time it remains within the internal combustion engine.

Ahmadi discloses a method for removing engine deposits in a gasoline internal combustion engine by introducing a cleaning composition into an air-intake manifold of a warmed-up and idling engine. Ahmadi's primary focus in on the composition of the solvent and the nitrogen-containing detergent additive that is used in the method of removing engine deposits. The apparatus that is used to deliver the cleaning solutions is nothing more than a water bottle with a long nozzle allowing direct contact with various elements of the internal combustion engine. Similarly with Chen, Ahmadi introduces the solvent and nitrogen-containing detergent solutions into the air intake of an idling engine and is removed upon prolonged use and numerous refueling of the internal combustion engine. It is uncertain how the solvent and the nitrogen-containing detergent solutions will impact on maintenance and efficiency of the internal combustion engine.

As such, there is a need for an EGR cleaning station and method of use that can overcome the drawbacks as described above. What is required is an EGR cleaning station and method of use that is a standalone unit that can be used during times of non-operation or during internal combustion engine service. The EGR cleaning station should also isolate the EGR element while without the necessity of removing it completely from the internal combustion engine. Additionally, there is a need for an EGR element cleaner and method which, upon cleaning the EGR element, removes all cleaning solutions and detergents from the EGR element, thereby ensuring that no new chemical compounds are introduced into the internal combustion engine during its operation.

SUMMARY

The present invention provides an exhaust gas recirculation cleaning station and method of use for efficiently cleaning EGR from soot and debris. The EGR cleaning station is primarily comprised of: a cleaning tank; a water tank; a heating system; a pump; an inlet hose; an outlet hose; and, exterior housing. The cleaning of the EGR occurs without the need to remove the EGR components from the internal combustion engine. Proper cleaning of the EGR improves efficiency of the internal combustion engines and minimizes cost of repair.

BRIEF DESCRIPTION OF THE DRAWINGS

It will now be convenient to describe the invention with particular reference to one embodiment of the present invention. It will be appreciated that the drawings relate to one embodiment of the present invention only and are not to be taken as limiting the invention.

DETAILED DESCRIPTION

The present invention will now be described more fully hereinafter with reference to the accompanying drawings, in which preferred and other embodiments of the invention are shown. No embodiment described below limits any claimed invention and any claimed invention may cover processes or apparatuses that are not described below. The claimed inventions are not limited to apparatuses or processes having all the features of any one apparatus or process described below or to features common to multiple or all of the apparatuses described below. It is possible that an apparatus or process described below is not an embodiment of any claimed invention. The applicants, inventors or owners reserve all rights that they may have in any invention claimed in this document, for example the right to claim such an invention in a continuing application and do not intend to abandon, disclaim or dedicate to the public any such invention by its disclosure in this document.

The terms "coupled" and "connected", along with their derivatives, may be used herein. It should be understood that these terms are not intended as synonyms for each other. Rather, in particular embodiments, "connected" may be used to indicate that two or more elements are in direct physical or electrical contact with each other. "Coupled" may be used to indicated that two or more elements are in either direct or indirect (with other intervening elements between them) physical or electrical contact with each other, or that the two or more elements co-operate or interact with each other (e.g. as in a cause and effect relationship).

Figure 1:
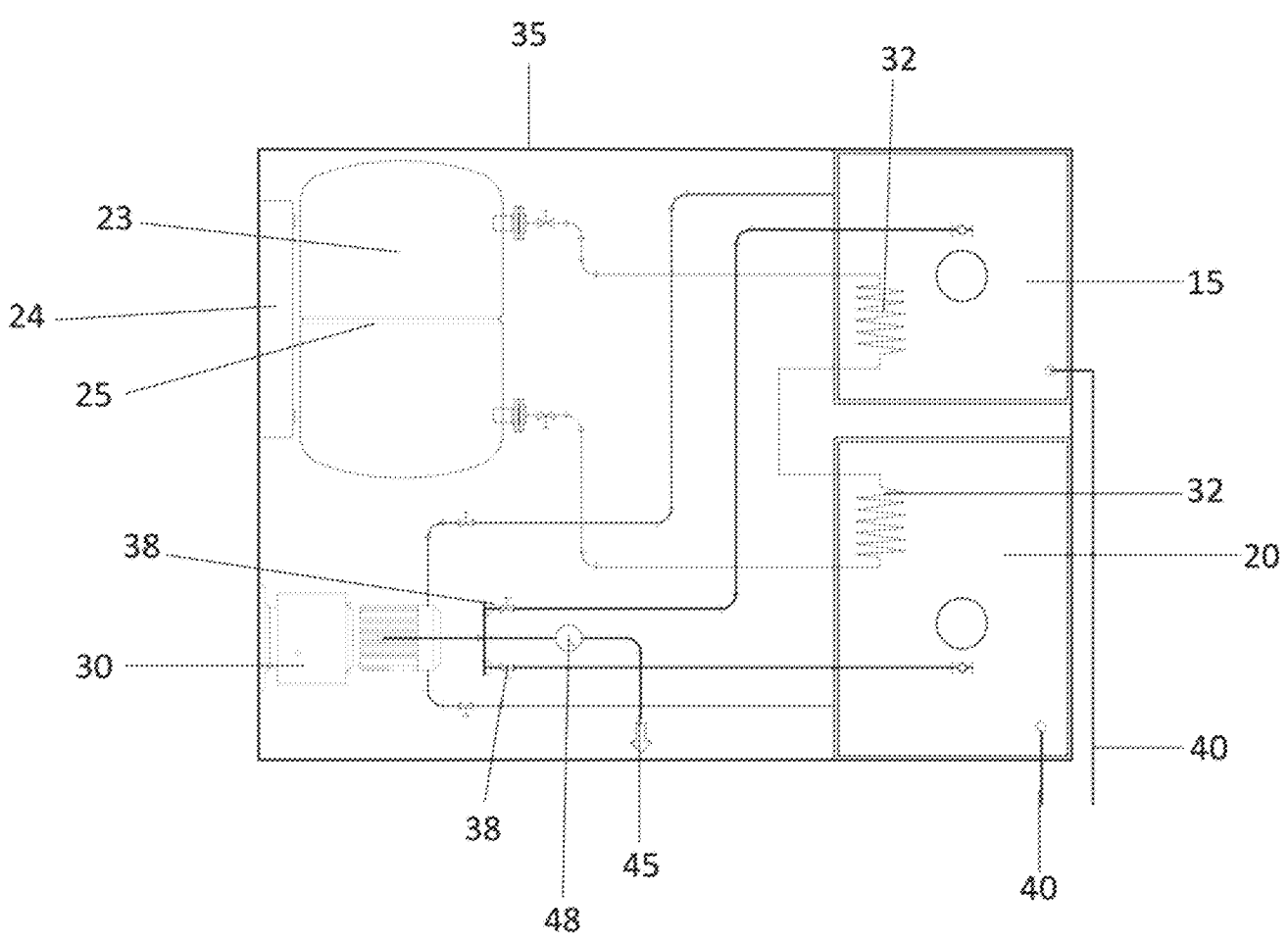
FIG. 1 is a top view of an exhaust gas recirculation cleaning station, according to one embodiment of the present invention.

With reference to FIG. 1 and according to one embodiment of the present invention, an exhaust gas recirculation cleaner station (the "EGR cleaning station") is shown. The EGR cleaning station 10 is primarily composed of: a cleaning tank 15; a water tank 20, a heating system 25; a pump 30; and, an exterior housing 35. The exterior housing 35 encapsulates all of the elements of the EGR cleaner station 10. The EGR cleaner station 10 is used to clean the exhaust gas recirculation (the "EGR") of internal combustion engines (not shown) without removing the EGR from the engine. Removal of the EGR from the internal combustion engine (not shown) is complex and time consuming. Often, to remove the EGR from the internal combustion engine (not shown) requires quite a number of additional steps, including but not limited to the removal of other engine parts and body panels. The cleaning of the EGR of internal combustion engines (not shown) is a key service feature that is required for maintenance of the engines and a great means of increasing the efficiency while in operation. Internal combustion engines, during operation, through ignition of fuel, produce a large amount of debris and soot. The accumulated debris and soot are recirculated throughout the internal combustion engine (not show) and over time the soot starts to accumulate on the surfaces of the EGR and other internal combustion engine elements. The accumulation of debris and soot causes engine malfunctioning, clogging of filters and chambers, and pits the inner surface components. The issues that are as a result of accumulation of debris and soot have a dramatic monetary impact, as the engine repair is not only costly, but also removes the vehicle from the road causing inconvenience for the owner/operator.

In operation, the EGR cleaner station 10, is attached to the opposite ends of the EGR of the internal combustion engine (not shown). The attachments (not shown) easily set within the hood compartment of the vehicle (not shown) and provide access to the EGR cleaner station 10 to the internal compartment of the EGR of the internal combustion engine (not shown). To properly clean the EGR of the internal combustion engine (not shown) the internal combustion engine temperature is increased. This can be accomplished by idling the engine for 30-45 minutes. A worker skilled in the relevant art would appreciate the various means of increasing the temperature of the EGR of the internal combustion engine (not shown). In addition, the contents stored in the water tank 20 and cleaning tank 15 are heated to a temperature of 100° F. to 140° F. In the present invention the stored contents are liquids. In one embodiment, the liquids in the water tank 20 and cleaning tank 15 are heated through a heat exchange 35. The heat exchange 32 is a coil that is connected to the heating system 25. The heating system heats up a liquid in the heating tank 23 and a heat pump 24 circulates the heated liquid through the heat exchange 32. In doing so, the surface of the heat exchange warms up, which in turn warms up the liquid in the water tank 20 and the cleaning tank 15. A worker skilled in the relevant art would appreciate the various means of increasing the temperature of the liquids in the water tank 20 and the cleaning tank 15, including but not limited to propane heat or electrical heat placed on the outer surface of the water tank 20 and cleaning tank 15, and the use of electrical coils within the water tank 20 and cleaning tank 15. Once optimal temperatures are reached in the water tank 20 and the cleaning tank 15, along with the EGR of the internal combustion engine (not shown), the inlet and outlet sealing adaptors (not shown) are set on the ports of the exhaust and intake manifold regions of the EGR of the internal combustion engine (not shown). The EGR cleaning station 10 is connected to the sealing adaptor (not shown), with the return hose 40 is attached to the outlet sealing adaptor (not shown) and the direct hose 45 is attached to the inlet sealing adaptor (not shown). The pump 30 is initiated, and cleaning solution is cycled from the cleaning tank 15 through the direct hose 45 into the EGR of the internal combustion engine (not shown) and back into the cleaning tank 15 at an initial pressure of 15 pounds per square inch (psi). The initial psi pressure can be increased or decreased through the manipulation of the pressure valve 48. The cycling of the solution is permitted for two to four hours or until such time as the pressure has dropped to 2 psi. The decrease in pressure is an indication that the soot and debris has been removed from the EGR of the internal combustion engine (not shown). Through the removal of the soot and debris, the cleaning solution is no longer obstructed within the EGR of the internal combustion engine (not shown) allowing the fluid to flow with less resistance, thus causing the decrease in pressure. The soot and debris is removed from the EGR of the internal combustion engine (not shown) and accumulates in the cleaning tank 15. Upon completion of the cleaning solution cycling, the water is subsequently cycled from the water tank 20 into the EGR (not shown). The cleaning tank 15 is removed from fluid connection with the EGR (not shown) and the water tank is inserted into fluid connection with the EGR (not shown). The removal and insertion of the cleaning tank and water tank is accomplished through valve adjustments along the fluid pathway 38. A worker skilled in the relevant art would appreciate the various means of efficiently changing the tanks that are in fluid connection with the EGR (not shown). The direct hose 45 and return hose 40 provide the fluid connection between the EGR (not shown) and the water tank 20. Water is cycled through the EGR (not shown) and the water tank 20 at a constant pressure of 2 psi. The water is cycled through the EGR (not shown) to remove any residual cleaning solution. The removal of a residual cleaning solution from the EGR of the internal combustion engine (not shown) ensures that all electronic elements and sensors do not contain a film or surface mineralization of the cleaning solution.

The cleaning solution used in the EGR cleaner station 10 is a common EGR cooler cleaner solution that can be readily purchased over the counter. The cleaning solution is primarily comprised of cleaning chemicals such as, but not limited to: Ethylene Glycol Monobutyl Ether; Alkylphenol ethoxylate; Sodium Hydroxide; and, Coco Ammonium Chloride Ethoxylated. A worker skilled in the relevant art would appreciate the characteristics needed by the cleaning solution to lift and remove soot from the surfaces of the EGR (not shown). Common elements that comprise the cleaning solution are interchangeable and can be substituted or modified as required based on the level of toxicity and cleaning force required. One common cleaning solution that can be used within the EGR cleaning station 10 is a commercially available product with a trade name of EGR Cooler Cleaner Solution I and II. Other nonspecific cleaning solutions can be used within the EGR cleaning station 10 as long as they contain properties conducive to lifting and removing soot from the EGR (not shown).

The EGR cleaning station 10 can be modified to contain multiple cleaning tanks 15, multiple water tanks 20, and multiple pumps in order to clean multiple EGRs of multiple internal combustion engines simultaneously. A worker skilled in the relevant art would appreciate the various means of modifying the EGR cleaning station 10 to allow for multiple EGRs of various internal combustion engines to be cleaned simultaneously by a single EGR cleaning station.

In an alternative embodiment of the present invention, the pump station and the method and use of exhaust gas recirculation elements cleaner is incorporated into the vehicle that contains the internal combustion engine. The on board EGR cleaning station would operate automatically without the need for maintenance stops. In this embodiment, the EGR cleaning station is incorporated into the body of the vehicle and would activate based on the kilometers driven since last EGR cleaning. The EGR cleaning station would be permanently attached onto the terminal ends of the EGR through sealing adaptors containing a valve system. During engine is operating, the valves are closed and cover the bores and the sealing adaptors of the EGR cleaning station. During use of EGR cleaning station, the valve opens to expose the bores to the EGR cleaning station while simultaneously blocking the EGR from the intake manifold and the exhaust manifold. A worker skilled in the relevant art would appreciate the various means that two channels that are side by side can operate in an alternate fashion. In this embodiment, the soot and the debris never accumulates to the point where individual elements, such as the EGR metering device ports need to be individually cleaned.

Figure 2:
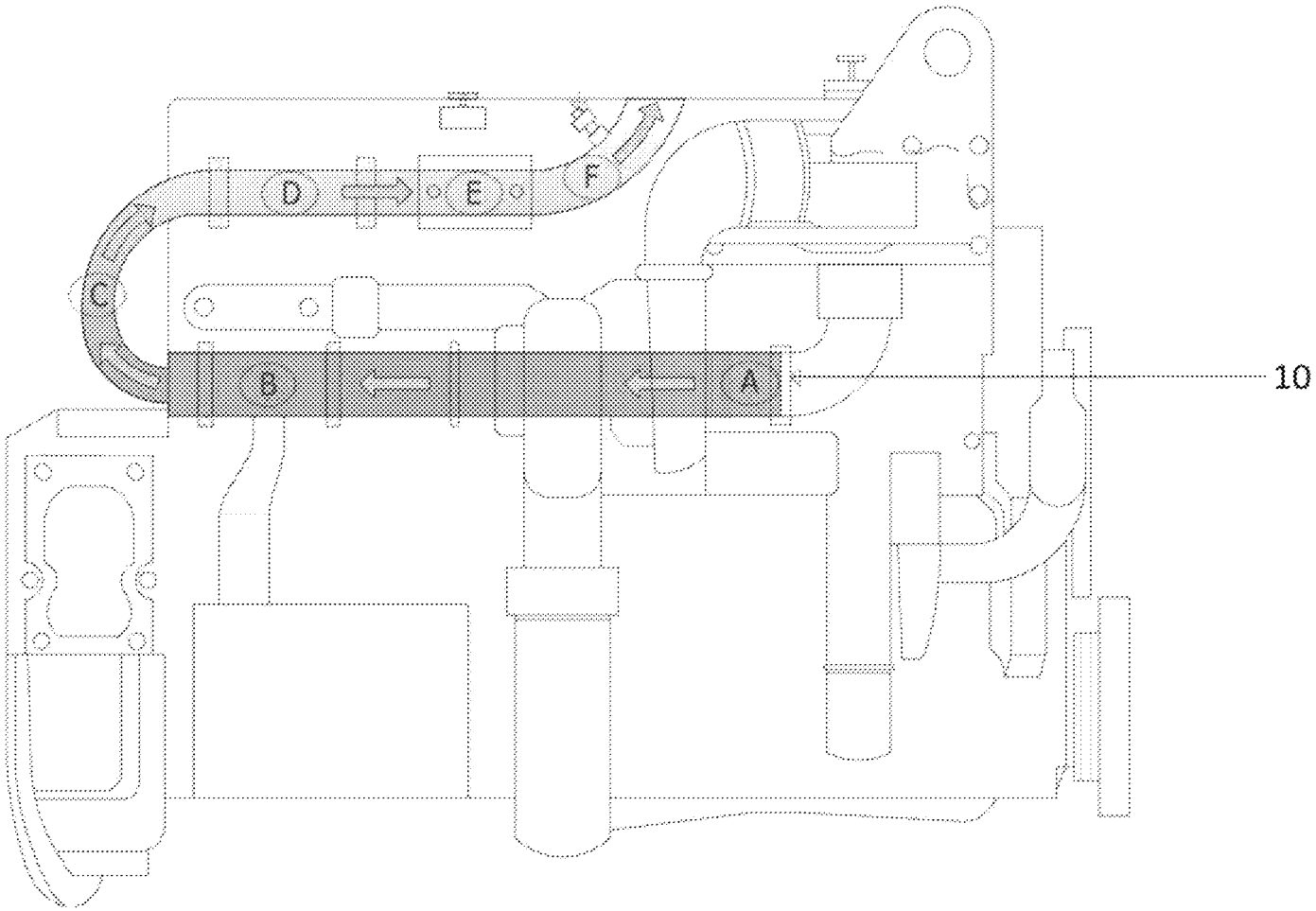
FIG. 2 is a side view of a common exhaust gas recirculatory on a Volvo™ diesel engine, according to one embodiment of the present invention.
Figure 3:
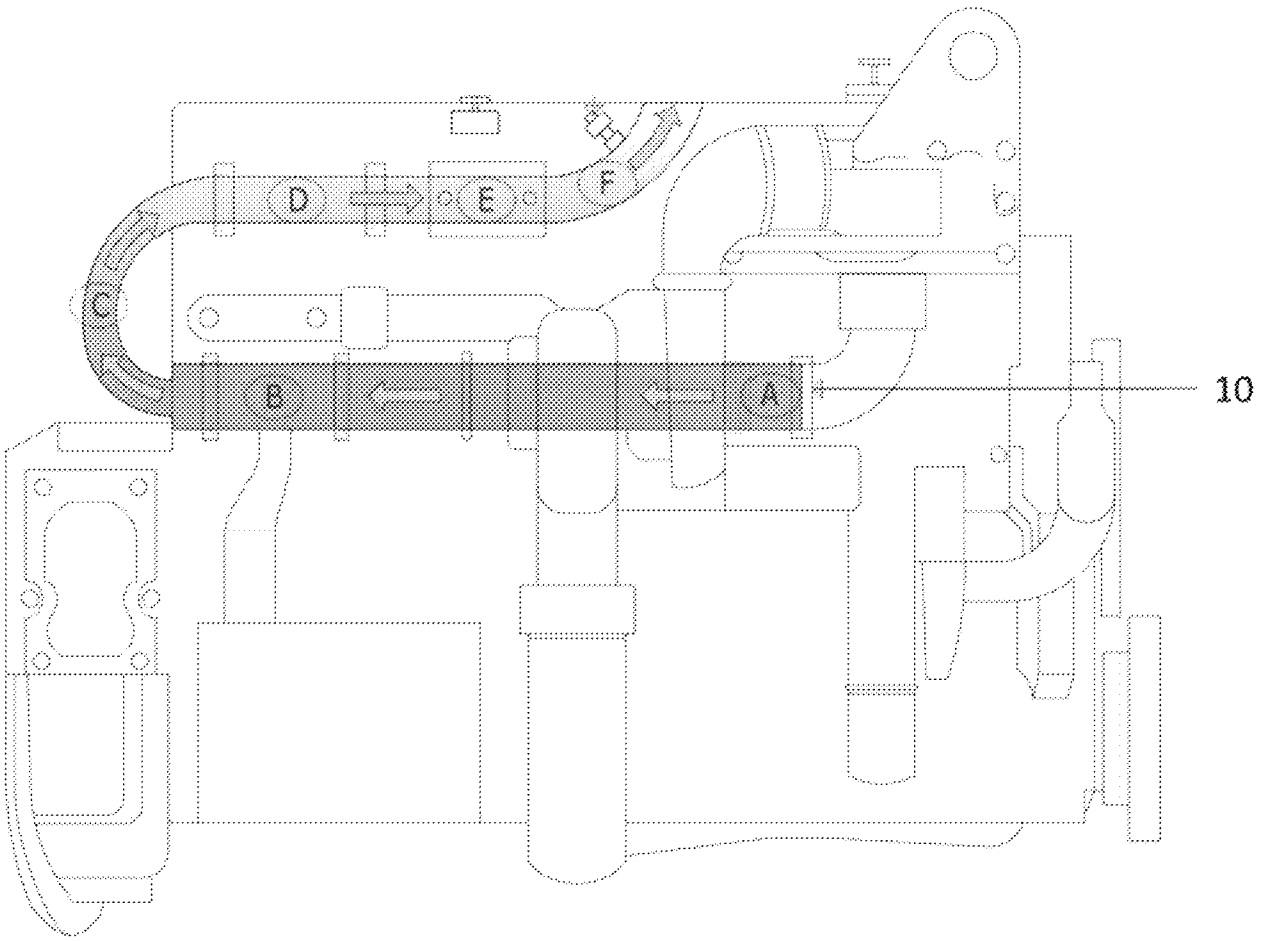
FIG. 3 is a side view of a common exhaust gas recirculatory on a Cummins™ diesel engine, according to one embodiment of the present invention.

With reference to FIG. 2 and FIG. 3, and according to one embodiment of the present invention, an EGR of internal combustion engines is shown. The EGR of internal combustion engines varies based on the type of engine and the manufacturer. The EGR of internal combustion engines is constructed around the internal combustion engine. As a result, the EGR of internal combustion engines are often differently shaped based on the type of engine and how the internal combustion engine was constructed. With specific reference to FIG. 2, an example of a typical Volvo™ diesel engine is shown. The EGR is depicted in the darker grey, starting at location A and ending at location F. For greater certainty, A denotes the EGR inlet and F denotes EGR outlet. The EGR inlet is at the connection point of the intake manifold and the EGR outlet is at the connection point of the exhaust manifold. The EGR, due to the engine type and engine construction, is fitted around the external surface area of the internal combustion engine through the use of a "S" shaped pattern. Removal of the EGR from the internal combustion engine would require an almost complete removal of the internal combustion engine from the engine bay (not shown). This would be quite labor intensive and time consuming. The EGR cleaning station (not shown) alleviates the necessity to remove the EGR from the internal combustion engine by attaching to the EGR at the inlet and outlet of the EGR. The connection of the EGR cleaner station to the EGR effectively isolates the EGR from the internal combustion engine, thereby allowing the cleaning solution and water to circulate through the EGR alone. A baffle is found on the sealing adaptors at the inlet and outlet of the EGR, wherein upon pressure from the EGR cleaning station a baffle (not shown) opens into the EGR thereby setting into the EGR and effectively sealing the EGR from the internal combustion engine (not shown). A worker skilled in the relevant art would appreciate the various means of isolating the EGR from the internal combustion engine (not shown), including but not limited to: rubber extension on the sealing adaptors; and, a cork inserted prior. With specific reference to FIG. 3, an example of a typical Cummings™ diesel engine is shown. The EGR is depicted in the darker grey, starting at location A and ending at location F. For greater certainty, A denotes the EGR inlet and F denotes EGR outlet. The overall shape of the EGR is markedly different from the shape of the EGR as depicted in FIG. 2. In this example, the removal of the EGR from the internal combustion engine would be just as complex and time consuming as described for the removal of the EGR in FIG. 2.

Figure 4A:
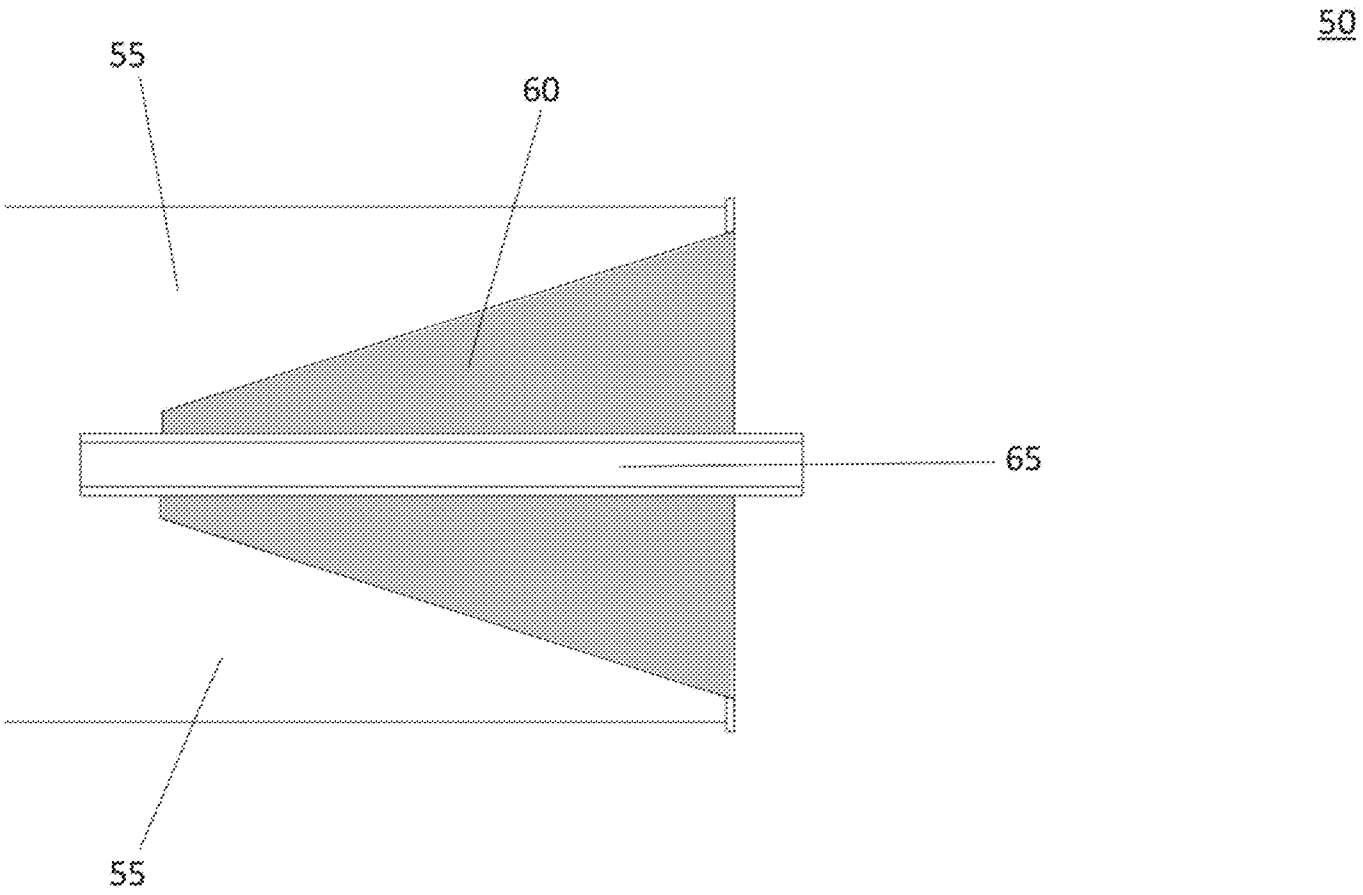
FIG. 4*a* is a cross sectional view of the universal tapered inlet adaptor, according to one embodiment of the present invention.
Figure 4B:
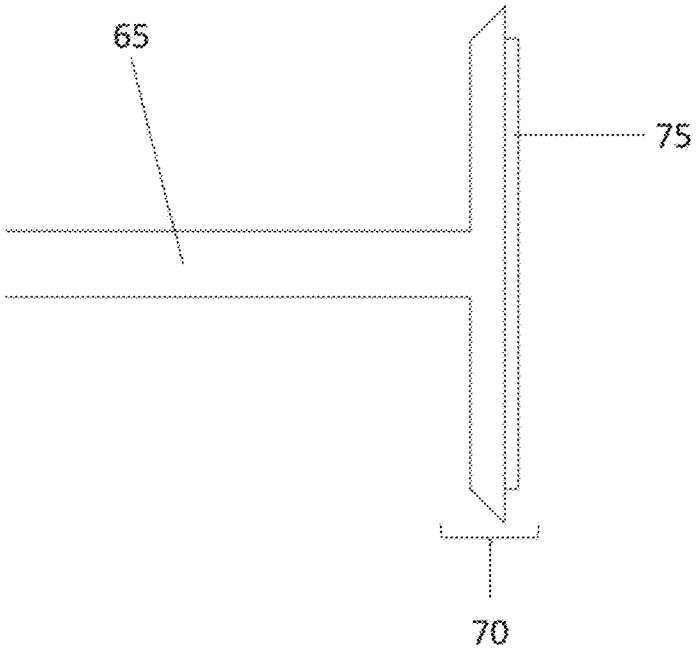
FIG. 4*b* is a side view of the mating flange inlet adaptor, according to one embodiment of the present invention.

With reference to FIGS. 4*a* and 4*b*, and according to one embodiment of the present invention, two various sealing adaptors 50 are shown. The variation between the sealing adaptors 50 relates to the mode of sealing into the bore of the EGR 55 for fluid connection with the EGR cleaning station (not shown). Depending on the type of bore opening at the inlet and outlet terminal ends of the EGR 55 will determine the type of sealing adaptor 50 capable of ensuring a tight seal between the EGR cleaning station (not shown) and the EGR 55. With specific reference to FIG. 4*a*, a sealing adaptor 50 is shown having tapered cone connection means 60. The tapered cone connection means 60 allows the inlet adaptor to have a universal fit to most common bores of EGRs 55 as the tapered cone connection means 60 can set within various shapes and sizes of bores at the inlet and outlet terminal ends of the EGR 55. The tapered cone connection means 60 is comprised of a malleable compound that can alter its shape when pressure is applied. In addition, the tapered cone connection means 60 can also contain a staggered step outer shape (not shown) that further enhances the tight seal between the sealing adaptor 50 and the EGR 55. A cross-sectional view of the tapered cone connection means is shown in FIG. 4*a*. A hose 65 is positioned at the center of the tapered connection means 60 and provides a channel wherein the water or cleaning solution (not shown) can pass from the EGR cleaning station (not shown) to the EGR 55. The hose 65 is in fluid connection with the EGR cleaning station (not shown) through a fluid connection with a return hose or a direct hose (not shown). A tight seal is created between the EGR 55 and the tapered cone connection means 60 which prevents water or cleaning solution (not shown) from escaping the EGR 55 while the EGR cleaning station (not shown) is in operation. A clamp (not shown) is clamped affixes the tapered cone connection means 60 and the hose 65 of the EGR cleaning station (not shown) to the EGR 55 to create a tight seal. The seal is required to withstand liquid pressures of 15 psi. A worker skilled in the art would appreciate the various affixing means wherein the tapered cone connection is securely sealed within the bore of EGR 55. With specific reference to FIG. 4*b*, a sealing adaptor 50 is shown having a mating V band flange connection means 70. The V band flange connection means 70 contains an O-ring seal 75 that ensures a watertight connection between the hose 65 of the EGR cleaning station (not shown) and the EGR (not shown). The V band flange connection means 70 is specific for each opening or bore of the inlet and outlet terminal ends of the EGR (not shown). The V band flange connection means 70 is required to be the same diameter and flange thickness as the opening or bore of the inlet and outlet terminal ends of the EGR (not shown). A V band Flange Clamp (not shown) seals the V band flange connection means 70 of the sealing adaptor 50 to the EGR (not shown). A worker skilled in the relevant art would appreciate the various V band flange connection means 70 required to ensure that all openings or ports of EGR (not shown) have their specific mating partners.

Figure 5:
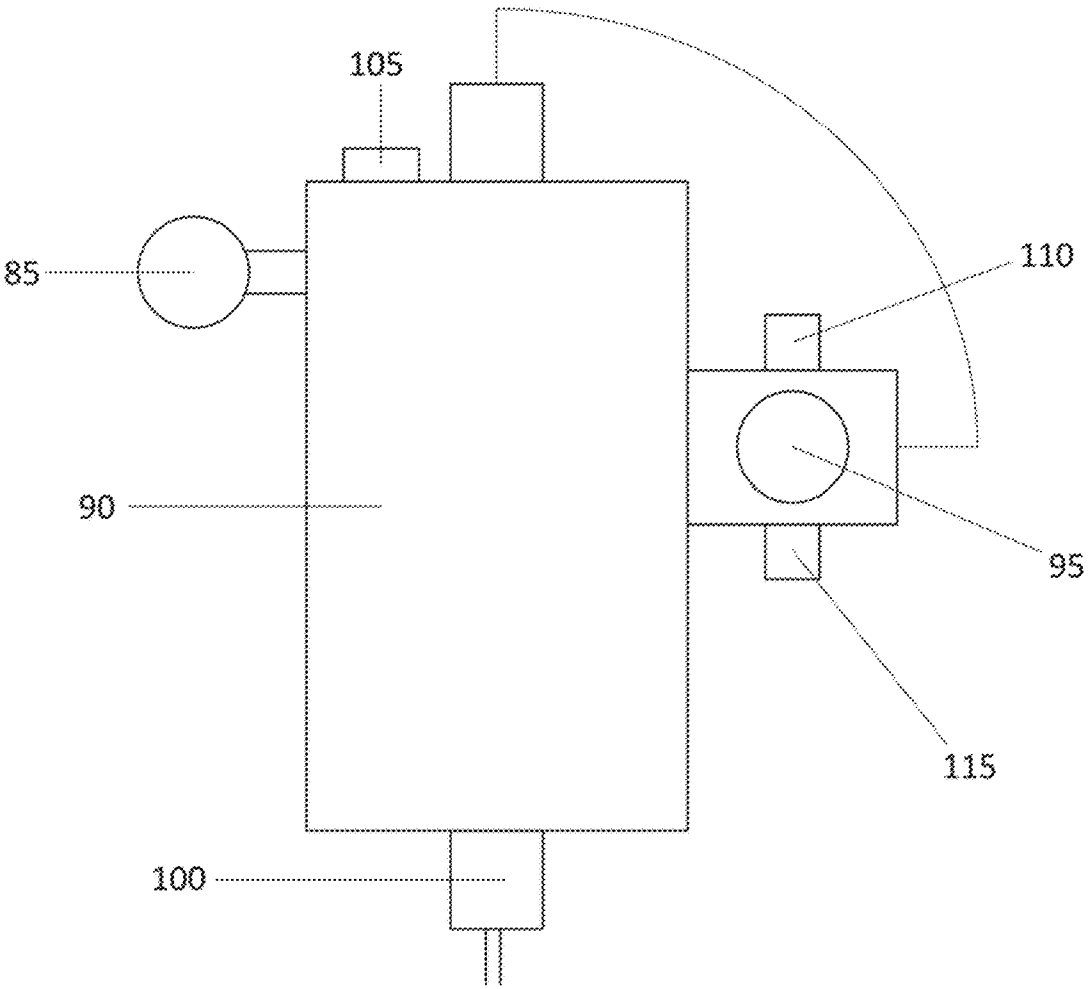
FIG. 5 is a schematic representation of the pressure pot, according to one embodiment of the present invention.

With reference to FIG. 5 and according to one embodiment of the present invention, a pressure pot 80 is shown. The pressure pot 80 is used in EGR cleaning station (not shown) as a standalone device that further cleans the EGR (not show) by ensuring that inner metering device ports ("ports") of the EGR (not shown) are completely cleaned. The Pressure pot 80 is primarily comprised of: a gauge 85; holding tank 90; air regulator 95; pressurized cleaner out 100; liquid fill port 105; regulator outlet pressure 110; and regulator inlet pressure 115. The liquid fill port 105 is used to fill the holding tank 90 with the cleaning solution (not shown). The cleaning solution (not shown), once in the holding tank 90 is pressurised to 50 psi. The pressure in the holding tank 90 can vary from 10 to 70 psi. A worker skilled in the relevant art would understand the various pressures required to expel the cleaning solution (not shown) from the pressure pot 80 at sufficient velocity to dislodge soot from inner ports of the EGR (not shown). The pressure within the holding tank 90 is displayed on the gauge 85. Pressure within the pressurised holding tank 90 is regulated by the air regulator 95 which maintains the. Through modification of the pressure by the air regulator 95 a user of the pressure pot 80 can modify the pressure within the pressurised holding tank 90. Modification of the pressure within the pressurised holding tank 90 is dependent on the location of the ports of the EGR and the accumulation of soot on those ports (not shown). Increased distance from the pressure pot 80 to the ports of the EGR will require a higher cleaning solution (not shown) ejection velocity which is accomplished through an increased pressure within the pressurised holding tank 90.

Similarly, a heavy accumulation of soot within the ports of the EGR requires increased cleaning solution ejection velocity to thoroughly expel the soot. The ejection of the cleaning solution (not shown) is controlled by the pressurized cleaner out 100. The pressurized cleaner out 100 is comprised of a ball valve which starts and stops the flow of the pressurized cleaning solution (not shown) from the holding tank 90. A worker skilled in the relevant art would appreciate the various means to control the ejection of pressurized cleaning solution, including but not limited to: ball valves; air solenoid valves; and, electric solenoid valves. The pressurized cleaner out 100 connects to the FES connector hose (not shown) and eject cleaning solution (not shown) directly at the ports of the EGR. The regulator inlet and outlet pressure, 110 and 115, respectively, control the pressure within the pressurised holding tank 90. As cleaning solution (not shown) is expelled from the pressure pot 80, pressure can become unregulated as volume remaining in the holding tank 90 decreases. The regulator inlet and outlet pressure, 110 and 115 respectively, control and maintains consistent pressure within the pressurised holding tank 90.

In another embodiment of the present invention, the pressure pot 80 is incorporated into the EGR cleaning station. The system operates to ensure that the inner metering device ports ("ports") of the EGR are thoroughly cleaned. Through the use of additional pressure valve(s) connected to the outlet of the EGR cleaning station the ports of the EGR (not shown) can be cleaned with high efficiency. A bypass valve connects to the outlet of the EGR cleaning station. The bypass valve that is capable, on request, of diverting a portion of the flow of the cleaning solution exiting the EGR cleaning station to a secondary element. The secondary element is comprised of a pressure regulator, a pressure valve gauge, a U-shaped cleaning solution recirculatory element, and FES connector hoses. As the cleaning solution is bypassed to the secondary element, the cleaning solution pressure is increased to 50 psi. The increased pressure can vary from 10 to 70 psi. A worker skilled in the relevant art would understand that the pressure causes the cleaning solution to expel at a sufficient velocity to dislodge soot from the inner ports of the EGR. Heavy accumulation of soot within the ports of the EGR requires increased cleaning solution ejection velocity. A worker skilled in the relevant art would appreciate that a variation of increasing pressure and/or increasing time is an effective means at cleaning heavy accumulation of soot within the ports of EGR. The ejection of the cleaning solution is controlled by the pressurized cleaner out. The pressurized cleaner out is comprised of a ball valve which starts and stops the flow of the pressurized cleaning solution. A worker skilled in the relevant art would appreciate the various means to control the ejection o pressurized cleaning solution, including but not limited to: ball valves; air solenoid valves' and, electric solenoid valves. The pressurized cleaner out connects to the FES connector hose and ejects cleaning solution directly at the ports of the EGR and is recirculated through the U-shaped cleaning solution recirculatory element.

Figure 6:
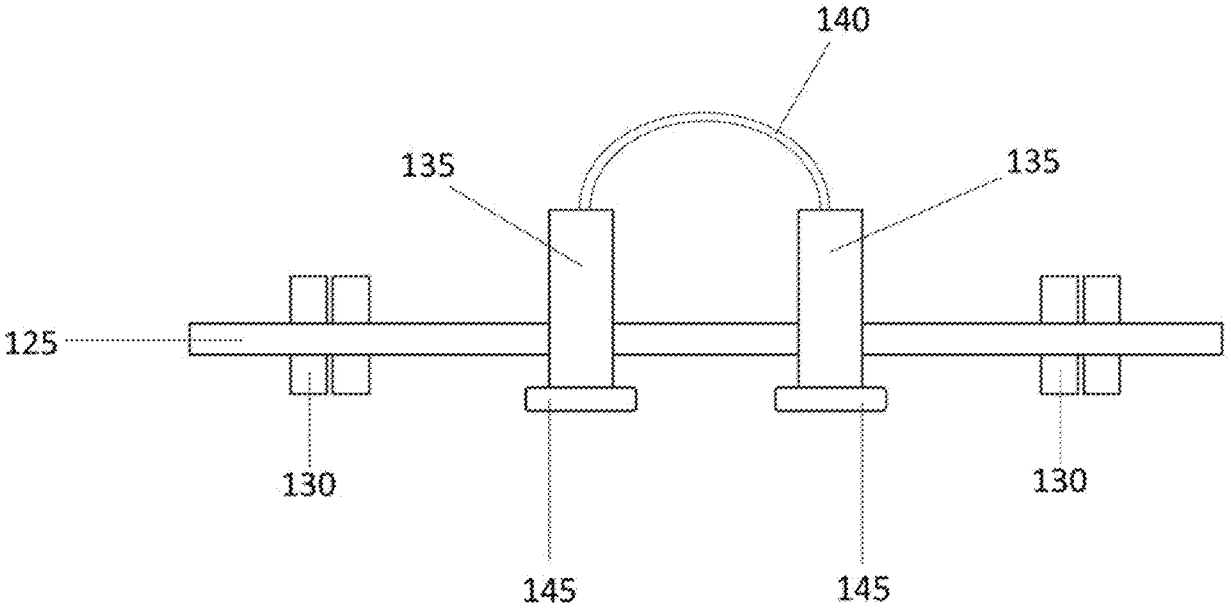
FIG. 6 is a schematic representation of metering device attached to the pass trough ports of the EGR, according to one embodiment of the present invention.

With reference to FIG. 6 and according to one embodiment of the present invention, the metering device jointer 120 is shown in greater detail. For ease of understanding a schematic representation of the metering device jointer 120 attached to the EGR ports are shown. The metering device jointer 120 is primarily comprised of: a base plate 125; mounting hardware 130; pass through ports 135; and, pass through port jointer 140. The metering device joinder 120 is used as part of the water wash portion of the EGR cleaning by EGR cleaning station (not shown). At the water wash portion of the EGR cleaning, water is passed through the EGR to remove excess cleaning solution to remove film or surface mineralization. The metering device joinder 120 ensures that sufficient circulation of water flows across the EGR ports (not shown). The metering device jointer 120 is attached to the EGR (not shown) through the mounting hardware 130. The mounting hardware 130 connects to the EGR through a universal and adjustable clamp and mounting hardware (not shown). A worker skilled in the relevant art would appreciate the various connection means to connect the mounting hardware 130 to the EGR including but not limited to: threaded fasteners; and, spring tentioners. Once connected, the base plate 125 positions the pass through ports 135 directly opposing the EGR ports (not shown). The location of the pass through ports 135 along the base plate 125 is adjustable, thereby allowing pass through ports 135 to be adjusted depending on the type of engine and construction of the EGR (not shown). The pass through ports 135 are in fluid connection with adjacent pass through ports 135 through the use of a pass through port jointer 140. The pass through jointer 140 is a hollow tube that permits fluid connectivity between the pass through ports 135, thereby allowing water to circulate through the pass through ports 135 and increasing the water circulation across the EGR ports. The increased water circulation across the EGR pores ensures that the pores are sufficiently rinsed in an effort to reduce the likelihood of cleaning solution (not shown) remaining deposited within the EGR ports which can cause film or surface mineralization of the cleaning solution (not shown) in the ports. The reduction of residual cleaning solution from the EGR ports are essential proper functioning of most engines. The EGR ports house a variety of sensors which provide vital information regarding engine function and engine efficiency. If one of the sensors is obstructed by cleaning solution film or mineralization, it can induce sensor misreading and affect engine efficiency or unnecessarily alert the driver of an error that requires additional maintenance. The pass trough ports 135 maintain a tight seal onto the EGR ports through sealing O-rings 145. A worker skilled in the relevant area would appreciate the various sealing means that can be employed to ensure a tight seal between the EGR ports and the pass through ports PP.

Figure 7:
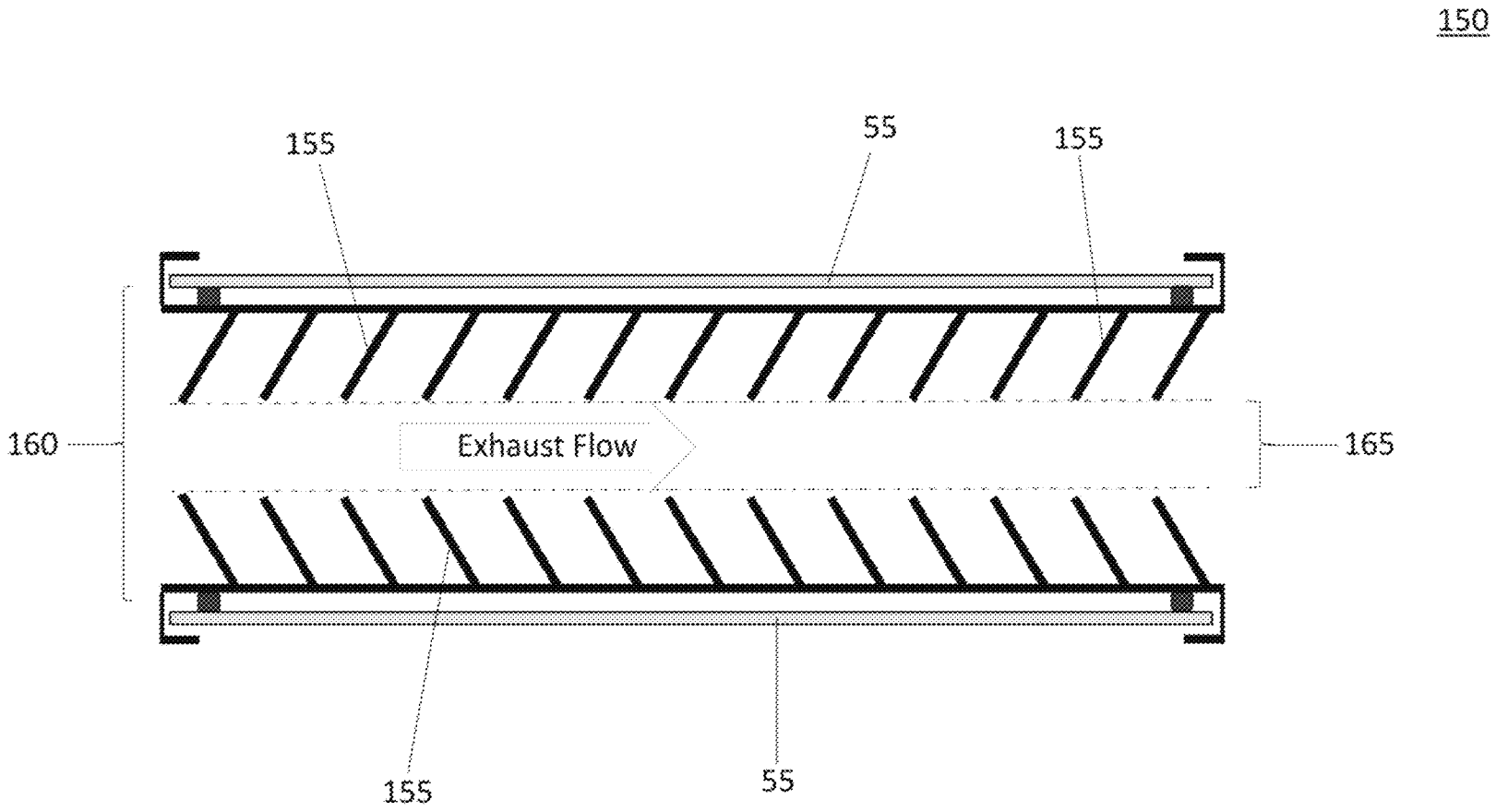
FIG. 7 is a cross-section view of a section of the EGR with a baffle filter set within, according to one embodiment of the present invention; and, FIGS. 8 and 9 is a method of use of the gas recirculation cleaning station, according to one embodiment of the present invention.

With reference to FIG. 7 and according to one embodiment of the present invention, an EGR filter 150 is shown. For ease of understanding, a cross-sectional view of an EGR 55 containing the EGR filter 150 is shown. The EGR filter 150 provides for collection and removal of soot and reduces the amount of debris from circulating within the EGR and the internal combustion engines (not shown) and, as a result, limiting the ability of the soot and debris to pit the interior surface of the EGR. The EGR filter 150 is comprised of a long tube-like structure that sets within the inner circumference of the EGR. The long tube-like structure contains a number of cross member filaments 155 protruding inwardly within EGR filter channel 160. The cross member filaments 155 are angled against the flow of the circulating exhaust within the EGR 55. The angle of the cross member filaments 155 is between 30° to 90° in relation to the inner surface of the EGR filter 150. Each cross member filaments 155 extends 5-40% of the total diameter of the channel 160. As such, at least 20% of the inner channel diameter 165 is unobstructed, thereby allowing a free flow of air and gas to pass. The at least 20% of the inner channel diameter unobstructed is essential to prevent back pressure, which would in turn cause a number of sensors of the internal combustion engine (not shown) to activate and alert the driver of a potential blockage. The cross member filaments 155 can also be constructed of a mesh like structure to capture soot while allowing exhaust to pass. The mesh like structure will capture the soot, but allow it to collect that base along the tube like structure. A worker skilled at the relevant art would appreciate the various mesh like structures and filter thickness to capture the soot while allowing the exhaust gas to pass through. The EGR filter 150 functions by capturing and collecting soot and debris. Each cross member filament 155 is angled towards the direction of the gas flow and acts as a passive means to capture and collect soot and debris from the circulating gas. The length of the cross member filament 155 relates to the amount of soot and debris that can be captured before the filter is saturated and needs replacing. The length of the cross member filament 155 is directly related to the flow rate of the gas passing through the EGR. The faster the flow rate, the greater the need for unobstructed passage, and as a result the shorter the cross member filament 155. Similarly, the slower the flow rate, the lower the need for unobstructed passage and as such, the longer the cross member filaments 155 to collect soot and debris. It has been observed that the soot and debris, having a larger density, travel lower in the EGR. As such, only the bottom cross member filaments are only required to capture 70% of the soot. The space between the individual cross member 155 is essential in soot retention and EGR filter 150 durability. Greater retention requires a larger gap between the individual cross member filaments 155. A slow flow rate would allow for a larger gap between each cross member filament 155, as there is a lower chance of air currents to disrupt the collected soot and debris. The larger gap between the cross member filaments 155 allows for a greater amount of soot to be collected. Based on the average gas flow rate found in the EGR of most internal combustion engines (not shown), the distance between each cross member filament 70 ranges from 2 cm to 10 cm.

In another embodiment, the EGR filter 150 is set horizontally within the EGR. In the horizontal orientation, the cross member filaments 155 extend horizontally with a filament arm extending across the EGR filter surface area to the base (not shown). The horizontal cross member filaments 155 catch soot that is traveling within the exhaust. The soot, accumulates on the cross member filaments 155 and upon reaching a critical mass slide down the extended filament arms (not shown), due on gravity, to the base of the EGR filter 150. A lip at the end of the EGR filter 150 (not shown) hold the soot within.

Figure 8:
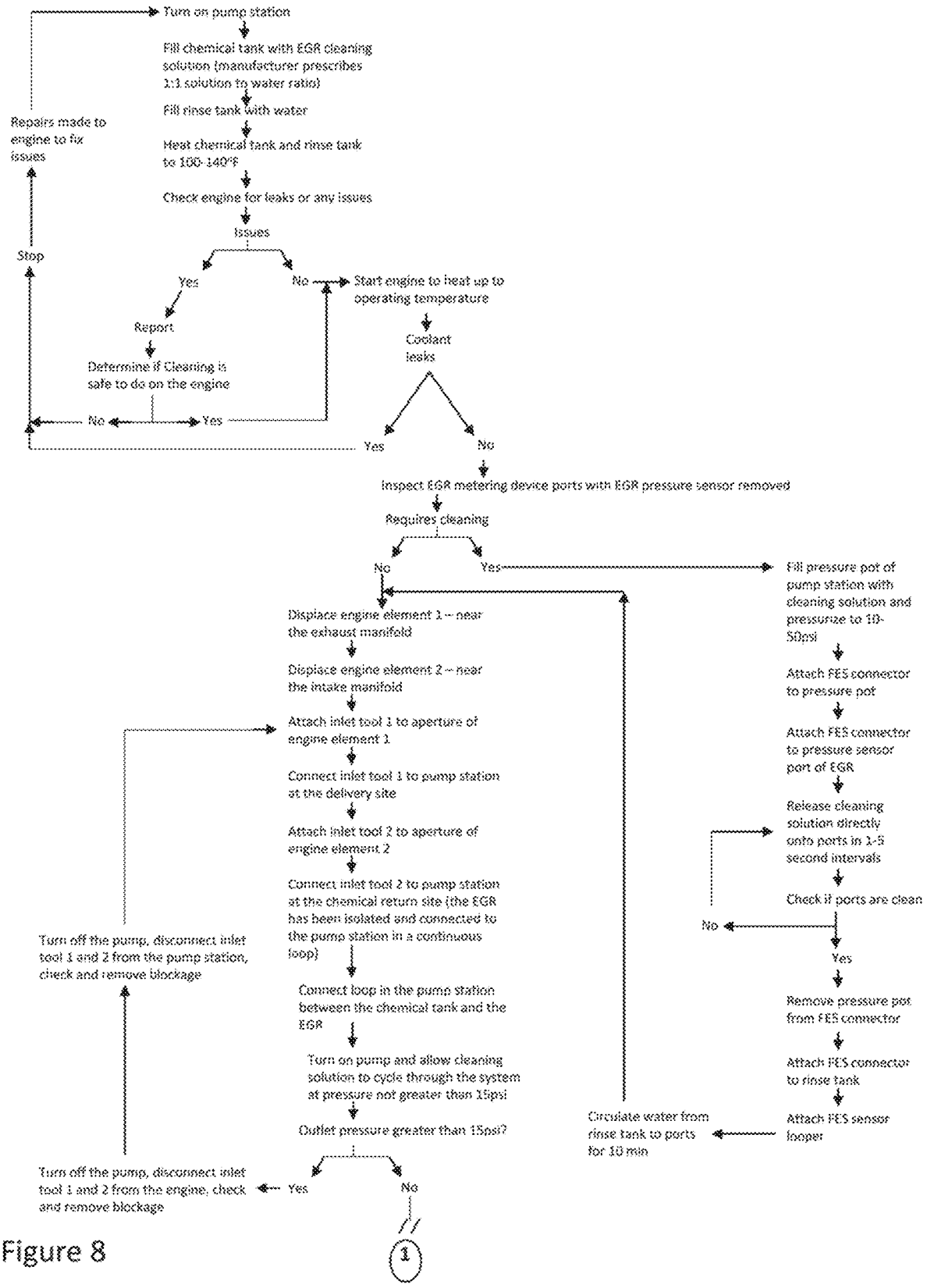
Figure 9:
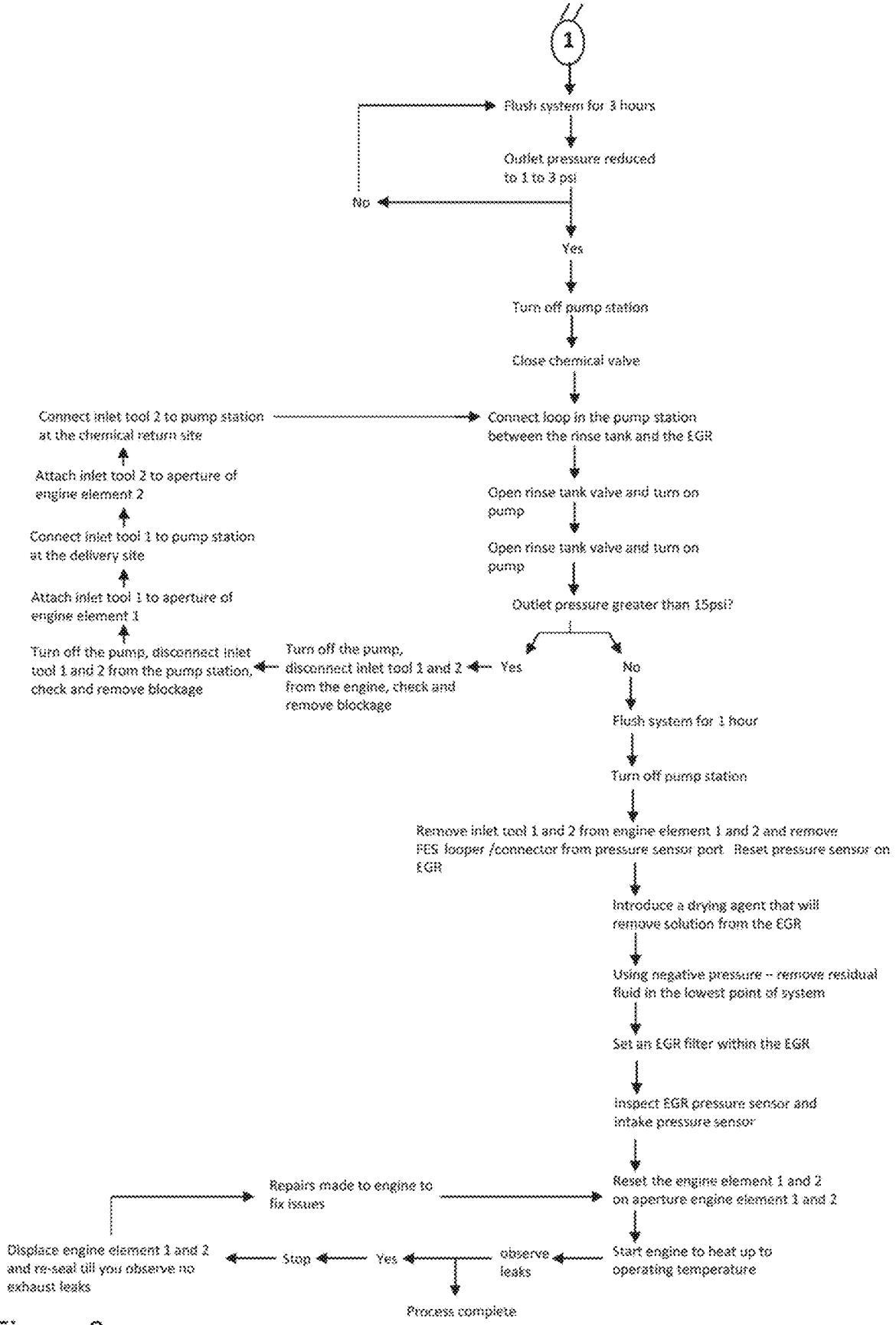

With reference to FIGS. 8 and 9 according to one embodiment of the present invention the method and use of exhaust gas recirculation elements cleaner is shown in greater detail. The pump station (not shown) is used along with the pressure pot (not shown) to clean all elements of the EGR system (not shown) of an internal combustion engine (not shown). A worker skilled in the relevant art would appreciate the various means of incorporating the pressure pot (not shown) within the pump station (not shown) while still maintaining the function of each element. The method is started with turning on the pump station and filling the cleaning tank with EGR cleaning solution at a 1:1 water ratio. The water tank is filled with water. The cleaning tank is heated to temperatures between 100-140° F. A worker skilled in the relevant art would appreciate the various temperatures that the EGR cleaning solutions would be heated varies based on the type of EGR cleaning solution and the respective manufacturers suggested operating temperature. Additionally, a worker skilled in the relevant art would appreciate the various means by which the cleaning tank is heated. While the cleaning tank is being heated, the internal combustion engine and its EGR (not shown) is inspected for any signs of damage, or leakage. If damage or leakage is observed, it is reported and an assessment on the engine and its EGR is made to determine whether it is safe to continue with the EGR cleaning. If the engine and its EGR is damaged to the point where cleaning is not possible, the method for cleaning the exhaust gas recirculation elements is stopped until repairs to the internal combustion engine are made. Once it is determined that the internal combustion engine and its EGR are in a condition where it is safe to perform the EGR cleaning, the engine is turned on to increase the engine temperature to its optimal operating temperature. A worker skilled in the relevant art would appreciate the various means of increasing the temperature of an engine. Once at optimal operating temperature, the engine is checked once more for any leaks. If leaks are observed the method of cleaning is stopped until such time as the engine is repaired. It is at this point that the internal combustion engine is deemed to be safe to perform the method of cleaning the EGR.

Once the internal combustion engine has reached its operating temperature, the EGR pressure sensor (not shown) is removed from the internal combustion engine and the EGR metering device ports (not shown) are inspected for debris. Debris within the EGR metering device ports is an indication that the EGR metering device ports need to be directly targeted for cleaning. A pressure pot is used to directly target the EGR metering device ports. The pressure pot is filled with cleaning solution and pressurized to 10 to 50 psi. An FES connector hose is attached to the pressure pot. The FES connector hose is used to expel the pressurized cleaning solution. The FES connector hose contains a valve which focuses the cleaning solution in a powerful stream. A worker skilled in the relevant art would appreciate the various nozzles and valves that can be used at in conjunction with the FES connector hose to focus and increase the pressure of the cleaning solution stream. The FES connector hose is attached to the pressure sensor port of the EGR and the valve is directed towards the EGR metering device ports. The pressurized cleaning solution is released from the pressure pot through the FES connector hose directly onto the EGR metering device ports in one (1) to five (5) second intervals and is repeated until the EGR metering device ports are clean. Depending on the debris accumulation, the pressurized release of the cleaning solution would be done 5-15 times before all of the debris is removed. A worker skilled in the relevant art would appreciate the fine balance of using high pressure to remove the debris, but low enough as to not damage the EGR metering device ports. Once the EGR metering device have been sufficiently cleaned, the FES connector hose is removed from the pressure pot and attached to the rinse tank. A FES sensor looper is connected onto the individual EGR metering device ports and allows for efficient flow of fluid to run through each EGR metering device ports. Water is circulated to the EGR metering device ports through the FES connector hose for approximately 10 minutes. A worker skilled in the relevant art and with knowledge of fluid dynamics would understand the time required to flush the EGR metering device ports is, in part based the flow rate and ability of the fluid to efficient circulate.

To clean the EGR, the element 1 and element 2, near the exhaust manifold and the intake manifold, respectively need to be removed from the EGR to expose the bores. A worker skilled in the relevant art would appreciate the various components element 1 and element 2 can be comprised of based on the various internal combustion engine manufacturers requirements, such as but not limited to: screw caps; vents; housing; and plugs. A worker skilled in the relevant art would also appreciate the various way in which element 1 and element 2 can be connected to the EGR of the various internal combustion engine EGR. Once removed, the EGR's bores become exposed. Sealing adaptors are set within the bores of EGR. Sealing adaptors attach to the bores in an air tight fashion. A worker skilled in the relevant art would appreciate that the sealing adaptors are required to form around the bores. This type of air tight connection can be achieved by providing multiple various sealing adaptors that are specifically designed for bores on specific engines or accomplished through a universal fit sealing adaptor. A worker skilled in the relevant art would appreciate that the universal fit sealing adaptor would be comprised of various including but not limited to: press fit, foam, rubber gasket, rim comprised of expandable materials, and, various conical shapes that can be set within various sizes of apertures. The direct hose connected to the delivery of the pump station is attached to the sealing adaptor at the intake manifold bore and the return hose that is connected to the cleaning tank return is attached to the sealing adaptor at the exhaust manifold bore. A worker skilled at the relevant art would appreciate that the direct hose and the return hose can be attached to any bore of the EGR as the specific location is irrelevant as long as a complete loop with the EGR cleaning station is formed. The cleaning tank of the pump station is incorporated into the connection between the pump station and the EGR. A pump within the pump station is activated, and the cleaning solution begins to cycle through the EGR at a pressure not greater than 15 psi. A worker skilled in the relevant art would appreciate that the pump can be any mechanism which actively controls fluid motion. Inspection of the system is required if the pressure that the cleaning solution is cycled is higher than 15 psi, as high pressure is an indication of a blockage in some part of the pump station or EGR. The cleaning solution is cycled for three (3) hours. As the cleaning solution is cycled through the EGR, the debris and soot begin to be lifted from within the EGR, and as a result, the pressure of the liquid cycled decreases. The EGR is considered to be clean once the cleaning solution cycle pressure drops to one (1) to three (3) psi. It is at this point that soot and debris has been removed from the EGR and the cleaning solution containing the soot is returned to the cleaning tank for emptying.

Upon completion of the cleaning cycle, the EGR is now required to be rinsed in order to remove the excess cleaning solution remaining within the EGR. The pump within the EGR cleaning station is turned off, and the fluid connection with the EGR is transferred from the cleaning tank to the water tank. The transfer is accomplished through valve manipulation within the EGR pump station. The pump is turned back on and fluid pressure is set to 15 psi. If the fluid pressure rises above 15 psi, there is a blockage in either the pump station of the EGR. Water is recirculated through the EGR. For a thorough rise, water is passed through the FES sensor looper, thereby ensuring removal of cleaning solution from the EGR metering device ports. The EGR is flushed with water for 1 hour, upon which the pump station is turned off and the sealing adaptors are removed from engine bores. The FES sensor looper is removed and the FES connector is removed from the pressure sensor port of the EGR. The EGR pressure sensor is reset onto the EGR. At this point the EGR has been fully cleaned, and what remains is the process of removing any solution left within the EGR.

The excess solution is dried within the EGR through the introduction of an alcohol based drying liquid. The drying process is further assisted by the use of negative pressure, which forces any excess fluid that has not evaporated to be expelled from the EGR. A worker skilled in the relevant art would appreciate the various means of expelling liquid from a tube or a channel such as the EGR, which includes but not limited to: use of an evaporating agent; heating the tube or channel to fluid evaporation temperature, use of a moisture absorbing medium, and, air drying.

To limit future accumulation of soot and debris from the EGR, a EGR filter is inserted into the EGR. The EGR filter acts as a lining that covers the inner surface area of the EGR. The filter membrane not only protects from soot and debris from collecting on the surface of the EGR and internal combustion engine (not shown) but it also actively collects and traps soot and debris. Placement of the EGR filter within the EGR is accomplished by sliding the filter membrane through the exposed bore of the EGR. The EGR filter is positioned in an exhaust directed manner to allow for maximal soot capture. The membrane filter is set within the EGR through a locking mechanism onto the bores. A worker skilled in the relevant art would appreciate the various means locking the membrane filter within the EGR including but not limited to: clips; spring loading; and arm extensions that are pinched as the bores are closed.

The engine element 1 and 2 are reset on the bores while ensuring the filter membrane is locked into the inner surface area for the EGR. It is at this point that the EGR cleaning is complete, and the internal combustion engine can operate. The internal combustion engine is turned on and allowed to reach operating temperature. The engine is observed to determine if its functioning normally and if there are any observable leaks. Any observable issues are repaired and the engine is turned on and observed to ensure that the engine is functioning normally. It is at this point that method and use of EGR cleaning station is complete.

The method and use of exhaust gas recirculation elements cleaner is repeated on the engine every six (6) to twelve (12) months or 100,000 to 200,000 miles to ensure that the EGR and the EGR filter remain clean and the internal combustion engine is operating efficiently.

In an alternative embodiment of the present invention, the pump station and the method and use of exhaust gas recirculation elements cleaner is incorporated into the truck and operated automatically without the need for maintenance stops. The EGR cleaning station is permanently attached to the EGR. The sealing adaptors are permanently attached onto the bores located at the terminal ends of the EGR and operated through a valve system (not shown). During engine operation, the valves are closed and cover the bores from fluid communication with the EGR cleaning station. During use of EGR cleaning station, the valve opens to expose the bores to the EGR cleaning station while simultaneously blocking the EGR from the intake manifold and the exhaust manifold. A worker skilled in the relevant art would appreciate the various means that two channels can operate in an alternate fashion. In this embodiment, the soot and the debris never builds up to the point where individual elements, such as the EGR metering device ports need to be individually cleaned.

The invention claimed is:

1. A method of removing engine deposits and soot from an exhaust gas recirculation (EGR) element of an internal combustion engine using an EGR cleaning station comprising of steps: Increasing from an ambient temperature, the temperature of a cleaning solution and water housed within the EGR cleaning station; increasing from an ambient temperature, the temperature of the EGR; setting sealing adaptors of the EGR cleaning station within terminal ends of the EGR; forming a complete loop between the EGR cleaning station and the EGR; forming a fluid connection between the EGR and the cleaning solution within the EGR cleaning station; circulating the cleaning solution under pressure of 15 psi through the EGR for a fixed time period or until pressure drops to a preset value; forming a fluid connection between the EGR and the water within the EGR cleaning station; circulating the water through the EGR for one hour; removal of excess cleaning solution and water remaining within the EGR; and, removal of the sealing adaptors of the EGR cleaning station from the terminal ends of the EGR and connecting the EGR to the internal combustion engine; wherein the method of removing engine deposits isolates the EGR without requiring physical removal of the EGR.

2. The method of claim 1 wherein said EGR cleaning station is primed by connecting said EGR cleaning station to a chemical tank containing the cleaning solution.

3. The method of claim 1 wherein prior to initiating the method, determining whether cleaning is safe to perform on the engine.

4. The method of claim 1 further comprising selecting an inlet adaptor to prevent leaks from the terminal ends of the EGR.

5. The method of claim 1 wherein the cleaning solution temperature is increased from ambient temperature to a temperature exceeding 100° F.

6. The method of claim 1 wherein the water temperature is increased from ambient temperature to a temperature exceeding 100° F.

7. The method of claim 1 wherein the circulating the cleaning solution through an inlet hose through the EGR and back to the EGR cleaning station through an outlet hose for three hours followed by the circulating the water through the EGR for one hour.

8. The method of claim 1 wherein said forming of a fluid connection uses a seal wherein said seal comprises a V band flange connection.

9. The method of claim 1 wherein the EGR is heated from ambient temperature to a temperature between 50° F. to 100° F.

10. The method of claim 9 wherein, the EGR temperature is increased by operating the internal combustion engine at idle for 30 to 45 min prior to setting the sealing adaptors of the EGR cleaning station within terminal ends of the EGR.

* * * * *